United States Patent [19]

Gueret

[11] Patent Number: 4,898,193

[45] Date of Patent: Feb. 6, 1990

[54] BRUSH FOR THE APPLICATION OF COSMETIC PRODUCTS

[75] Inventor: Jean-Louis Gueret, Paris, France

[73] Assignee: L'Oreal, Paris, France

[21] Appl. No.: 110,526

[22] Filed: Oct. 20, 1987

[30] Foreign Application Priority Data

Oct. 24, 1986 [FR] France ..... 86 14774

[51] Int. Cl.[4] ..... A45D 40/26

[52] U.S. Cl. ..... 132/218; 15/206; 15/160; 15/159 A; 132/320

[58] Field of Search ..... 132/88.7, 85, 216, 217, 132/218, 313, 317, 320; 401/129, 126; 15/206, 160, 159 A

[56] References Cited

U.S. PATENT DOCUMENTS

| | | | |
|---|---|---|---|
| 3,459,199 | 8/1969 | Connell | 132/11 R |
| 3,930,280 | 1/1976 | Vasas | 132/85 |
| 3,998,235 | 12/1976 | Kingsford | 132/88.7 |
| 4,403,624 | 9/1983 | Montgomery | 132/88.7 |
| 4,586,520 | 5/1986 | Brittain | 132/88.7 |
| 4,600,328 | 7/1986 | Clements | 15/160 |
| 4,628,950 | 12/1986 | Bitzer | 132/88.7 |

FOREIGN PATENT DOCUMENTS

| | | |
|---|---|---|
| 00204466 | 12/1986 | European Pat. Off. . |
| 0237360 | 9/1987 | European Pat. Off. . |
| 2222048 | 10/1974 | France . |
| 2263723 | 10/1975 | France . |
| 2146520 | 4/1985 | United Kingdom . |
| 2170996 | 8/1986 | United Kingdom . |

*Primary Examiner*—Gene Mancene
*Assistant Examiner*—Adriene J. Lepiane
*Attorney, Agent, or Firm*—Cushman, Darby & Cushman

[57] ABSTRACT

This brush, in particular for the application of mascara to the eyelashes, is constituted by a central elongate core which is surrounded at least partly by bristles radially implanted along longitudinal rows, one row of longer bristles whose ends constitute a ridge alternating with one row of shorter bristles. According to the invention, the ends of the bristles situated between two adjacent ridges are contained in a surface-envelope with a non-convex profile (flat or with a concave profile). During making up, the lashes are separated by the bristles of each ridge and they are charged with the make-up product coming from the regions situated between the ridges which can constitute, by an appropriate choice of the number of ridges (four in particular), a large application surface. The manufacture of such a brush is extremely simple since it suffices to effect a peripheral milling of a brush of the conventional type.

10 Claims, 2 Drawing Sheets

BRUSH FOR THE APPLICATION OF COSMETIC PRODUCTS

FIELD OF THE INVENTION

The present invention concerns a brush for the application of cosmetic products, intended more particularly either for the making up of the eyelashes, for example a mascara brush, or for the application of hair dye.

PRIOR ART

The usual brushes of this kind comprise tufts of relatively long bristles disposed in rings or in spirals around a core or a support constituted by a twisted iron wire. Mascara brushes have the drawback of obtaining a poor spread of the make up product which, in practice, is found to occur in blobs without any homogeneity, which makes it difficult and time-consuming to obtain a suitable covering for the eyelashes by the make up product.

This drawback is due to the fact that these brushes comprise a large number of bristles producing a tangling of the eyelashes and shortcomings in the spreading of the product. Thus the spiral shape of the array of bristles does not ensure a combing of the lashes in the same way as could be done by a small separating comb.

To resolve this problem, a make up brush has already been proposed in U.S. Pat. No. 4586520 which comprises rows of short bristles alternating with rows of long bristles. The rows of long bristles are equivalent to a small comb ensuring a separation of the lashes in an efficient manner, with the object of ensuring a regular application of the make up on the lashes.

Now, it is found that this object is difficult to attain with this known make up brush, because the regions situated between the "combs" do not on the one hand, ensure a correct trapping of the make up product and do not, on the other hand, constitute, in conjunction with the ridges forming the rows of longer bristles, a sizable application area with a suitable profile. In fact, since the brush is made from a helical winding of bristles, the tips of the bristles having the shorter dimension are found to be contained in a cylindrical envelope. In these conditions, it will be clearly seen that the inter-ridge surfaces with a convex profile will not constitute ideal surfaces for applying the product to the lashes since, because of the presence of the ridges, they are not totally in contact with the lashes during the making up. This shortcoming is accentuated still further in that the generally cylindrical wiper lip of the mascara applicator device will perform its function of wiping the application surfaces where it would be desirable that they should not be wiped, at least not completely.

OBJECT OF THE INVENTION

It is an object of the present invention to overcome the disadvantages of the above-mentioned prior art.

It is a further object of the invention to modify the known brush so that the surface envelopes of the regions situated between two ridges are flat surfaces or have a concave profile.

It is a further object of the invention to ensure that the product is correctly taken up by the rows of short bristles which are not subjected to total wiping but do constitute an optimized application surface.

It is a further object of the invention to allow for many variants by varying the number of longitudinal ridges. However, it is preferable to restrict to three or four ridges, ensuring a good compromise between the combing of the lashes and a good application of the product.

Yet a further object of the invention is to enable the user to have the choice between a heavy make up if she does not cause the brush to turn on itself at the time of making up, using the inter-ridge spaces carrying the product to the best advantage, and a light make up if she causes the brush to turn on itself, thus simultaneously causing the ridges separating the eyelashes to come into action.

SUMMARY OF THE INVENTION

The present invention therefore provides a new industrial product constituted by a brush for the application of cosmetic products, in particular for the application of mascara to the eyelashes or of a dye on the hair, constituted by an elongate core which is surrounded, at least partly, by bristles implanted radially on said core and distributed substantially radially and along the longitudinal rows in the implantation zone, one longitudinal row of longer bristles whose ends constitute a ridge alternating with one longitudinal row of shorter bristles, characterised in that the ends of the bristles of the brush which are situated between two adjacent ridges are contained in a surface envelope with a non-convex profile, and in that the thickness of the ridges measured at the periphery of the brush is no greater than 1.5 mm.

Conveniently, the core of the brush is formed by bending a metallic wire back on itself, then by twisting this wire thus doubled around the core, so as to secure in position a helical array of radial bristles whose length is then adjusted by peripheral milling to constitute the ridges.

The central portion of the brush, delimited by the cylindrical envelope with a circular base containing the tips of the bristles with the smaller dimension, is advantageously sufficiently large to constitute during use a reserve of the cosmetic product to be applied.

Preferably, the brush has from three to six ridges for the implantation of the bristles over the whole periphery of the brush.

In a first embodiment of the present invention, this brush is inscribed as a whole within a straight cylinder with a circular base, having its axis identical with that of the core; the straight cylindrical envelope with a circular base containing the tips of the smaller dimension bristles is a cylinder coaxial with the first-mentioned cylinder.

In a second embodiment, the brush is inscribed as a whole in an elongate cone frustum tapering towards its free end with the axis identical with that of the core, and the straight cylindrical envelope with a circular base containing the tips of the smaller dimension bristles is an elongate cone frustum coaxial with the first-mentioned cone frustum.

The brush according to the invention can have various overall shapes. Thus in cross-section, it can have the overall shape of a regular polygon whose tips are constituted by the ridges. Moreover, the sides of this polygon can curve inwardly.

Moreover, the brush may have a diamond shape in cross-section, whereof each tip constitutes one ridge, it being possible for the sides of the diamond to curve inwardly.

In case of a make up brush, especially intended for the application of mascara to the eyelashes: the brush may be inscribed as a whole in a cylinder having a diameter of the order of 8 mm, or in a cone frustum whose diameter varies between 8 mm and 5 mm; its median portion delimited the tips of the bristles of the smaller dimension, may be inscribed respectively in a cylinder of 4.5 mm diameter or in a cone frustum whose diameter varies between approximately 4.5 mm and 3 mm; and the thickness of the ridges measured at the periphery of the brush may be of the order of 1 mm, each ridge representing the equivalent of a comb whose teeth, constituted by the bristles of one row, are interspaced by approximately 1 mm.

BRIEF DESCRIPTION OF THE DRAWINGS

To render the present invention more readily understood, several embodiments, represented in the attached drawings, will be described below on a purely indicative and non-restrictive basis. In these drawings:

FIG. 7 corresponds to the brush of FIG. 1.

DESCRIPTION OF THE PREFERRED EMBODIMENTS

Figure 1:
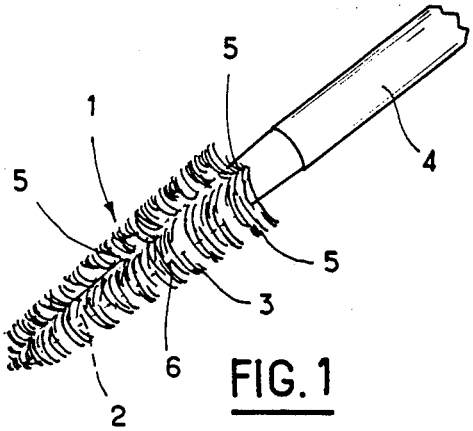
FIG. 1 is a view in perspective of the brush according to a first embodiment of the present invention.

If reference is now made to FIG. 1, it will be seen that a brush for eyelashes has been represented by 1 as a whole. This brush 1 is constituted by a central core 2 on whose periphery the bristles 3 are implanted, the core is, in the conventional way, constituted by a twisted iron wire holding a helical row of radial bristles in position. The core 2 is connected to the stem 4 of a conventional applicator device.

The bristles 3 are dimensioned so as to constitute four longitudinally extending ridges 5, regularly disposed around the brush 1.

The brush as a whole is inscribed in a cone frustum tapering towards the free end of the brush 1.

Between two adjacent ridges 5, the brush 1 has a surface envelope delimiting a furrow 6. The ends of those bristles 3 occurring at the bottom of these furrows 6 are contained in a cone frustum with its axis identical with that containing the ends of those bristles occurring at the level of the ridges 5.

The characteristic dimensions of this brush 1 are as follows

Length 20 to 30 mm.

The largest diameter measured at the tips of the bristles constituting the ridges 8 mm.

The smallest diameter measured at the tips of the bristles constituting the ridges 4.5 mm.

The largest diameter of the brush measured at the tips of the bristles constituting the bottom of the furrows 5 mm.

The smallest diameter of the brush measured at the tips of the bristles constituting the bottom of the furrows 3 mm.

The brush 1 is made, as in the case of a conventional brush, with a frusto-conical surface envelope which is modified by a milling operation, carried out four times, which cuts the bristles 3 so as to constitute the ridges 5 separated by the furrows 6.

The ridges 5 each constitute the equivalent of a comb whose teeth are constituted by tufts of bristles each corresponding to one row of bristles 3 and whose interspacing is of the order of 1 mm. Moreover, the thickness of each ridge 5 measured at the periphery of the brush 1 is of the order of 1 mm.

Figure 7:
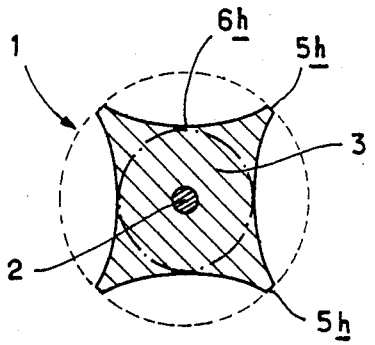
Figure 8:
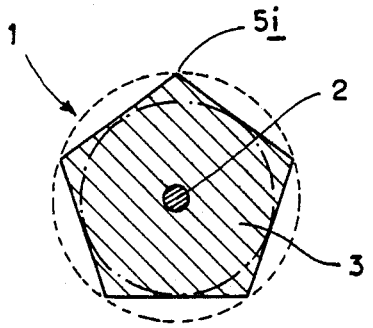
Figure 9:
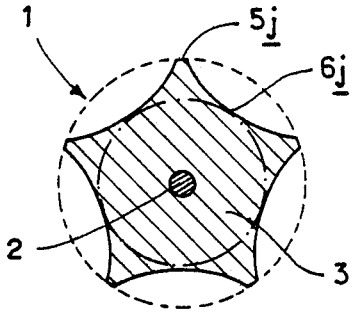

In FIG. 7, the external envelope of longer bristles, measured at the level of the ridge 5, has been represented by dashes and the envelope of the shorter bristles, measured at the bottom of the furrows 6, by dots and dashes; the whole zone comprising the bristles 3 has been hatched.

This same representation has been repeated in FIGS. 2 to 6 and 8 to 11 which each represent a respective possible overall form of the brush 1, resulting from an adjustment by milling a conventional brush with a cylindrical or frusto-conical surface envelope.

Figure 2:
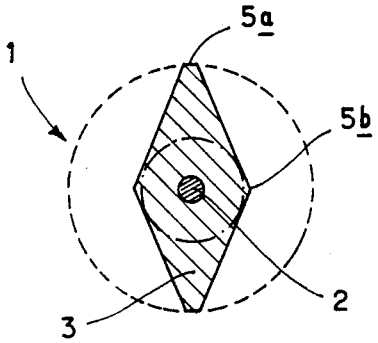
FIGS. 2 to 11 schematically represent cross-sectional views, in planes perpendicular to their cores, of various make-up brushes according to the invention.

FIG. 2 represents a brush having an overall diamond shape, constituting two main ridges **5*a* with flattened edges and two secondary pointed ridges 5*b***.

Figure 3:
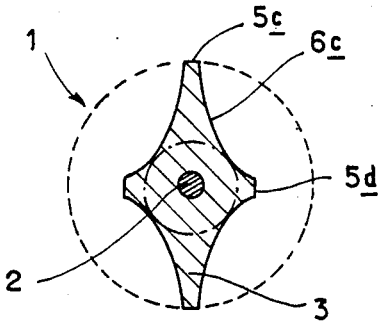

FIG. 3 represents a variant of the brush of FIG. 2, in which the sides of the diamond curve inwardly thereby also resulting in two main ridges **5*c* and two secondary ridges 5*d*, both with flattened edges. The furrows 6*c*** are arranged between the ridges.

Figure 4:
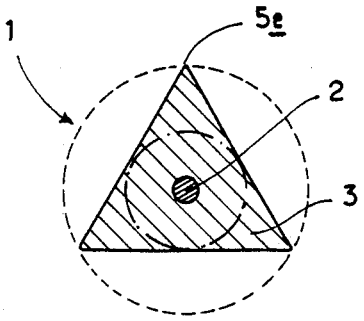
Figure 5:
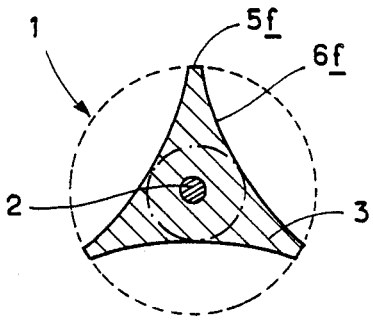
Figure 6:
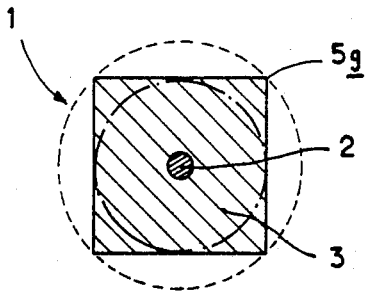

FIG. 4 represents a brush with a triangular cross-section, comprising three pointed ridges **5*e*; FIG. 5 represents a brush derived from that of FIG. 4 in that the sides of the triangle curve inwardly, resulting in ridges 5*f* with flattened edges, as in the case of FIG. 3, and furrows 6*f***.

Figure 10:
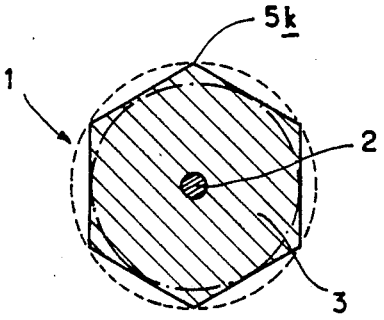
Figure 11:
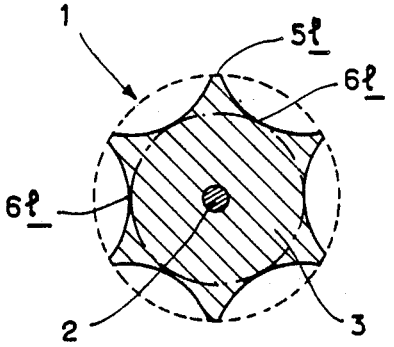

The same pairs of variants are found again for brushes with a square cross-section (FIGS. 6 and 7), with a pentagonal cross-section (FIGS. 8 and 9), and with a hexagonal cross-section (FIGS. 10 and 11). The letters associated with the reference numerals 5 for the ridges and 6 for the furrows are (only found in the case of FIGS. 7, 9 and 11) are respectively: g and h, (for FIGS. 6 and 7), i and j (for FIGS. 8 and 9) and k and 1 (for Figures 10 and 11).

When the user wishes to make up her lashes by means of the brush according to the invention, the proper penetration of the mascara between the lashes is effected by the ridges 5 which each act as a separating comb. In fact the lashes penetrate between the teeth of this "comb" and separate whilst coming to lick make up product from the zone joining the ridges.

Moreover, an attempt has been made to assess the improved separation of the eyelashes which can be obtained with the brushes in accordance with the present invention in relation to the behaviour of a conventional brush having an overall cylindrical shape. An ingenious comparative experiment substantiating this interesting characteristic is given below.

I. Make Up Procedure Schedule (a) Obtaining the False Eyelashes 10 grs. of a silicone resin marketed under the name of "Silflo", sold by the British Company "Flexico Ltd" are weighed into a container and 10 grs. of an appropriate catalyst are added. They are mixed until they are completely homogenized.

Two groups of about sixty each of adhesive false eyelashes made of natural hair, sold under the name of "LJC" by the Jeanne Cron Company, are glued to the edge of a cup with a 1 cm interval between the groups. The lashes of each group are disposed in sub-groups of approximately twenty hairs each disposed side-by-side, the length over which they are implanted being of the order of 1.5 mm so as to simulate a natural implantation of the eyelashes.

The silicone resin thus prepared is poured into the cup and care is taken to ensure that the roots of the false lashes are properly embedded. The test piece is allowed to harden and is extracted after 30 minutes.

(b) Making Up

The make up applicators are prepared on the day before the test, so that the brushes are properly impregnated. The mascara used is of the "mascara-cream" type corresponding to the most widely used type of mascara sold in the market.

On the day of the test, the false lashes are made up in the direction of normal implantation of the lashes. Five brush strokes are applied for each group of false lashes. The making up is performed by the same person under standard conditions for the set of false eyelash groups used in the experiment.

For each cup, the number of false lashes of each group is noted, N1 representing, for example, the number of false lashes situated to the left and M1 the number of false lashes situated to the right and the make up is carried out as indicated above, the false lashes situated on the left with the control brush and those situated on the right with a brush made according to the present invention and whose potential for separating the lashes one wishes to determine experimentally.

The control brush is a brush of a general frusto-conical shape.

The number of tufts of the false lashes is then counted in each case which is noted as N2 for the groups situated on the left (control brush) and as M2 for the group situated on the right.

II. Calculation of the Lash Separation coefficient C.

Theory

The lash separation coefficient C has been defined as follows:

$$C = \left(1 - \frac{M1}{M2} \times \frac{N2}{N1}\right) \times 100$$

which corresponds to the improvement percentage in the separation of the lashes.

In this way, the lash separation potential of six brushes has been experimentally determined, each brush conforming to one variant of the embodiment of the invention. The results are set out in the following Table:

| | Type of brush used | | | | | | |
|---|---|---|---|---|---|---|---|
| Test No. | General shape of the base | Cross section corresponding to that of Figure | N1 | N2 | M1 | M2 | C % |
| 1 | frustoconical | 5 | 61 | 8 | 61 | 14 | 42,9 |
| 2 | cylindrical | 5 | 57 | 6 | 59 | 14 | 55,6 |
| 3 | frustoconical | 7(1) | 59 | 7 | 67 | 17 | 53,2 |
| 4 | frustoconical | 7(2) | 60 | 10 | 61 | 15 | 32,2 |
| 5 | frustoconical | 7(3) | 62 | 10 | 67 | 14 | 22,8 |
| 6 | cylindrical | 7(4) | 60 | 7 | 60 | 15 | 53,3 |

The indices (1); (2); (3); (4): denote different thicknesses of the ridges at the periphery, this thickness increases progressively in this order by increments of at approximately 1 mm.

The indices (1); (2); (3); (4): denote different thicknesses of the ridges at the periphery, this thickness increases progressively in this order by increments of at approximately 1 mm.

(b) Results Obtained

It follows from the above Table that the separation of the lashes is effected by the experimental brushes which conform to the present invention with an improvement varying from 23 to 56%, which constitutes a remarkable result.

It shall be duly understood that the embodiments described above are in no way restrictive, and can give rise to any desirable modification without thereby departing from the scope of the present invention.

I claim:

1. A brush for the application of cosmetic products, comprising:

(a) an elongated core, and (b) a plurality of bristles, wherein said bristles are fixed around said core in a helical array with said bristles extending generally radially of said core and being shaped to form longitudinal rows of bristles arranged in sets, the bristles forming said rows having longer length than bristles immediately adjacent said rows, said bristles of one set of longitudinal rows having ends longer than those of another set of longitudinal rows of shorter length bristles, the ends of said bristles of longer length being milled to define ridges at the periphery of the brush having a thickness no greater than 1.5 mm, and wherein the ends of said bristles situated between adjacent ridges define a surface envelope having a concave profile.

2. A brush according to claim 1, having a central portion delimited by a straight cylindrical envelope with a circular base containing the tips of the shorter length bristles which is sufficiently large to constitute a reservoir for the cosmetic product to be applied.

3. A brush according to claim 1, wherein the bristles are implanted over the whole periphery of the core, and there are from three to six ridges.

4. A brush according to claim 1, wherein there are four ridges.

5. A brush according to claim 1, wherein the brush as a whole is inscribed in a first straight circular cylinder coaxial with the core, and wherein a circular cylindrical envelope containing tips of the shorter length bristles define a second circular cylinder coaxial with the first circular cylinder.

6. A brush according to claim 1, wherein the brush as a whole is inscribed in an elongate cone frustum tapering towards its free end and coaxial with the core, and wherein the shorter length bristles have tips defining a second elongate cone frustum coaxial with the first cone frustum.

7. A brush according to claim 1, having a cross-section in the overall shape of a regular polygon whose vertices are constituted by the ridges and whose sides are curved inwardly.

8. A brush according to claim 1, having a cross-section in the form of a diamond, each of the edges of which constitute a said ridge, wherein the sides of the diamond curve inwardly.

9. A brush according to claim 1, intended for the application of mascara to eyelashes, wherein the brush as a whole is inscribed in a cylinder of about 8 mm in diameter; wherein the shorter length bristles have tips defining a median portion inscribed in a cylinder 4.5 mm in diameter; and wherein the thickness of the ridges measured at the periphery of the brush is of the order of 1 mm, each ridge being equivalent to a comb whose teeth, constituted by the bristles of one row, are interspaced at intervals of about 1 mm

10. A brush according to claim 1, intended for the application of mascara to eyelashes, wherein the brush as a whole is inscribed in a cone frustum having a diameter varying between 8 mm and 5 mm; wherein the shorter length bristles have tips defining a median portion inscribed in a cone frustum having a diameter varying from about 4.5 mm to about 3 mm; and wherein the thickness of the ridges measured at the periphery of the brush is of the order of 1 mm, each ridge being equivalent to a comb whose teeth, constituted by the bristles of one row, are interspaced at intervals of about 1 mm.

* * * * *